US011058912B1

(12) United States Patent
Dunefsky

(10) Patent No.: US 11,058,912 B1
(45) Date of Patent: Jul. 13, 2021

(54) ADAPTIVE DEVICE UTILIZING NEUROPLASTICITY FOR THE REHABILITATION OF STROKE VICTIMS

(71) Applicant: Brooke Dunefsky, Irvington, NY (US)

(72) Inventor: Brooke Dunefsky, Irvington, NY (US)

( * ) Notice: Subject to any disclaimer, the term of this patent is extended or adjusted under 35 U.S.C. 154(b) by 0 days.

(21) Appl. No.: 17/141,181

(22) Filed: Jan. 4, 2021

(51) Int. Cl.

| | |
|---|---|
| ***A63B 22/00*** | (2006.01) |
| ***A63B 21/00*** | (2006.01) |
| ***A63B 21/015*** | (2006.01) |
| ***A63B 21/22*** | (2006.01) |
| ***A63B 24/00*** | (2006.01) |
| ***A63B 71/06*** | (2006.01) |

(52) U.S. Cl.
CPC .... *A63B 22/0005* (2015.10); *A63B 21/00069* (2013.01); *A63B 21/00192* (2013.01); *A63B 21/015* (2013.01); *A63B 21/225* (2013.01); *A63B 21/4035* (2015.10); *A63B 24/0087* (2013.01); *A63B 71/0619* (2013.01); *A63B 2022/0094* (2013.01); *A63B 2071/0658* (2013.01); *A63B 2225/50* (2013.01)

(58) Field of Classification Search
CPC ..... A63B 21/00058; A63B 21/00069; A63B 21/00076; A63B 21/00192; A63B 21/005; A63B 21/0051; A63B 21/0052; A63B 21/0056; A63B 21/0057; A63B 21/012; A63B 21/015; A63B 21/15; A63B 21/151; A63B 21/22; A63B 21/225; A63B 21/4027; A63B 21/4033; A63B 21/4035; A63B 21/4049; A63B 22/0002; A63B 22/0005; A63B 22/0046; A63B 22/0605; A63B 2022/0094; A63B 23/12; A63B 23/1209; A63B 23/1281; A63B 23/129; A63B 24/0062; A63B 24/0087; A63B 71/0009; A63B 71/0054; A63B 71/0619; A63B 2071/0063; A63B 2071/0072; A63B 2071/0658; A63B 2209/08; A63B 2213/00; A63B 2225/50
See application file for complete search history.

(56) References Cited

U.S. PATENT DOCUMENTS 4,765,315 A * 8/1988 Krukowski ..... A63B 21/0056 482/5
5,267,925 A * 12/1993 Boyd ..... A63B 21/0056 188/77 R
5,643,146 A * 7/1997 Stark ..... A63B 21/015 482/5
5,860,941 A * 1/1999 Saringer ..... A63B 21/0058 601/33

(Continued)

*Primary Examiner* — Gary D Urbiel Goldner

(57) ABSTRACT

An adaptive device utilizing neuroplasticity for a rehabilitation of stroke victims. The adaptive device includes a base platform, an elongated superstructure, a first axle, at least one interchangeable handle, and a torsional-resistance mechanism. The base platform and elongated superstructure suspend the first axle in an elevated position, wherein the interchangeable handle may freely rotate coaxial to the first axle. The torsional-resistance mechanism is operatively coupled to the first axle, providing a variable resistance to the rotation of the interchangeable handle. Thus, the interchangeable handle is configured to support a repetitive pronation-supination exercise to aid in rehabilitation and physical therapy.

15 Claims, 7 Drawing Sheets

(56) References Cited

U.S. PATENT DOCUMENTS 5,980,431 A * 11/1999 Miller, Jr. ..... A63B 22/0007 482/57
6,084,325 A * 7/2000 Hsu ..... A63B 21/0051 188/161
6,117,093 A * 9/2000 Carlson ..... A63B 21/0056 482/4
7,625,318 B1 * 12/2009 Heyn ..... A63B 21/4013 482/100
7,833,135 B2 * 11/2010 Radow ..... A63B 71/0622 482/57
7,862,476 B2 * 1/2011 Blau ..... A63B 24/0087 482/8
8,328,692 B2 * 12/2012 Lin ..... A63B 21/0053 482/2
9,999,818 B2 * 6/2018 Hawkins, III ..... A63B 69/16
10,398,933 B2 * 9/2019 Crist ..... A63B 22/0023
10,799,755 B2 * 10/2020 Cristofori ..... A63B 22/0087
10,933,290 B2 * 3/2021 Hawkins, III ..... A63B 21/225
2002/0193208 A1 * 12/2002 Inoue ..... A63B 22/0605 482/63
2006/0035755 A1 * 2/2006 Dalebout ..... A63B 22/0664 482/52
2006/0160669 A1 * 7/2006 Lizarralde ..... A63B 21/0051 482/63
2007/0149364 A1 * 6/2007 Blau ..... A63B 21/0053 482/57
2009/0011907 A1 * 1/2009 Radow ..... A63B 24/0084 482/57
2009/0036275 A1 * 2/2009 Hsiao ..... A63B 22/0605 482/63
2009/0253558 A1 * 10/2009 Lofgren ..... A63B 22/0005 482/51
2010/0022353 A1 * 1/2010 Hsiao ..... A63B 21/0053 482/2
2010/0069205 A1 * 3/2010 Lee ..... A63B 21/0051 482/63
2011/0118086 A1 * 5/2011 Radow ..... A63B 24/0062 482/5
2011/0234175 A1 * 9/2011 Hajee ..... A63B 22/0007 320/164
2012/0217758 A1 * 8/2012 Chen ..... A63B 21/225 290/1 C
2012/0283068 A1 * 11/2012 Lin ..... A63B 21/0052 482/2
2015/0174446 A1 * 6/2015 Chiang ..... A63B 21/227 482/8
2015/0174447 A1 * 6/2015 Chiang ..... A63B 22/0605 482/8
2015/0174449 A1 * 6/2015 Chiang ..... A63B 71/0054 482/6
2017/0106222 A1 * 4/2017 Mayer ..... A63B 22/0605
2018/0001142 A1 * 1/2018 Viarani ..... A63B 21/0051
2018/0036586 A1 * 2/2018 Cristofori ..... A63B 22/0605
2019/0262651 A1 * 8/2019 Huang ..... A63B 21/00069
2020/0023222 A1 * 1/2020 Zhou ..... A63B 21/225
2020/0147449 A1 * 5/2020 Liu ..... A63B 24/0087
2020/0298053 A1 * 9/2020 Meyer ..... A63B 22/0605
2020/0338383 A1 * 10/2020 Liu ..... A63B 21/00192

* cited by examiner

ADAPTIVE DEVICE UTILIZING NEUROPLASTICITY FOR THE REHABILITATION OF STROKE VICTIMS

FIELD OF THE INVENTION

The present invention relates generally to a device suitable for use as part of a physical rehabilitation regimen leveraging neuroplasticity to overcome damage caused by a stroke. More specifically, the present invention relates to an adaptable upper-limb exercise machine configured to continuously adjust to a patient's progress through a rehabilitation program.

BACKGROUND OF THE INVENTION

Recovering from any injury can become a grueling, drawn-out process involving many months or years of slowly rebuilding damaged muscles and tendons. This is doubly true with neurological damage, wherein the body must rely on neuroplasticity, or the ability for neural networks to grow and reconfigure in response to external stimuli. This capacity for change is immensely beneficial to people who have suffered brain damage, such as those who have suffered a stroke, because a brain may gradually reconstruct any healthy neural pathways around the damaged sections of brain tissue. However, this process still requires a source of stimuli to effectively 'reteach' a brain how to perform unconscious actions. Of particular interest to the proposed invention, the pronation or supination of the arm may be used as a bellwether for progress during a rehabilitation program. Absent the fine motor control necessary to perform these maneuvers, a patient may not utilize their hands to a full extent, as the wrist joint cannot supinate or pronate. Effectively, without the capacity to twist one's forearm, an entire axis of motion of the hand is lost.

Conventional exercises and therapies aimed at strengthening a patient's muscles or reforming the necessary neural motor pathways are commonly performed with the assistance of a physical therapist. This may be effective, but the requirement for a trained care provider to perform these exercises can limit the capacity for a patient to perform exercises as an when is most convenient. Further, the therapists themselves would be unlikely to acquire reliable data over time to track and adjust the rehabilitation process for an individual patient without some outside system to assist. It is therefore proposed that a mechanism may be provided that supplants a physical therapist for basic upper-limb exercises, thereby enabling a user to engage in rehabilitation programs at their own pace.

The present invention aims to provide a variable resistance exercise apparatus with integrated data-tracking capacity in at least one conceivable embodiment. The preferred iteration of the present invention will utilize a novel eddy current brake to provide infinitely variable, inherently smooth torsional resistance against the motion of a user's arm. Specifically, the present invention offers a variable resistance machine capable of supporting arm pronation and supination exercises as part of a physical rehabilitation process in conjunction with other extant and conventional treatments.

DETAIL DESCRIPTIONS OF THE INVENTION

All illustrations of the drawings are for the purpose of describing selected versions of the present invention and are not intended to limit the scope of the present invention.

As can be seen in FIG. 1 through FIG. 7, the preferred embodiment of the present invention provides an adaptive device utilizing neuroplasticity for the rehabilitation of stroke victims. More specifically, the present invention is directed towards means and devices suitable for resisting the pronation and supination of a user's arm while grasping at least one interchangeable handle. This repetitive action, when combined with other therapeutic exercises, has been observed to gradually increase the mobility and fine motor control of stroke victims. In order to create a personalized exercise program, the present invention is configurable to provide variable resistance to any pronation or supination movements via a torsional-resistance mechanism. This configuration is further supported by both manual and automatic adjustment means, i.e., the resistance may be continuously adjusted to provide a maximally challenging exercise. Though it is generally understood that the form factor or packaging of the present invention may vary across all conceivable embodiments, it is generally contemplated that the functional assembly described herein is uniquely suited to portable in-home machines operated by a single user, negating the requirement for a physical therapist to ensure proper performance of an exercise.

Figure 1:
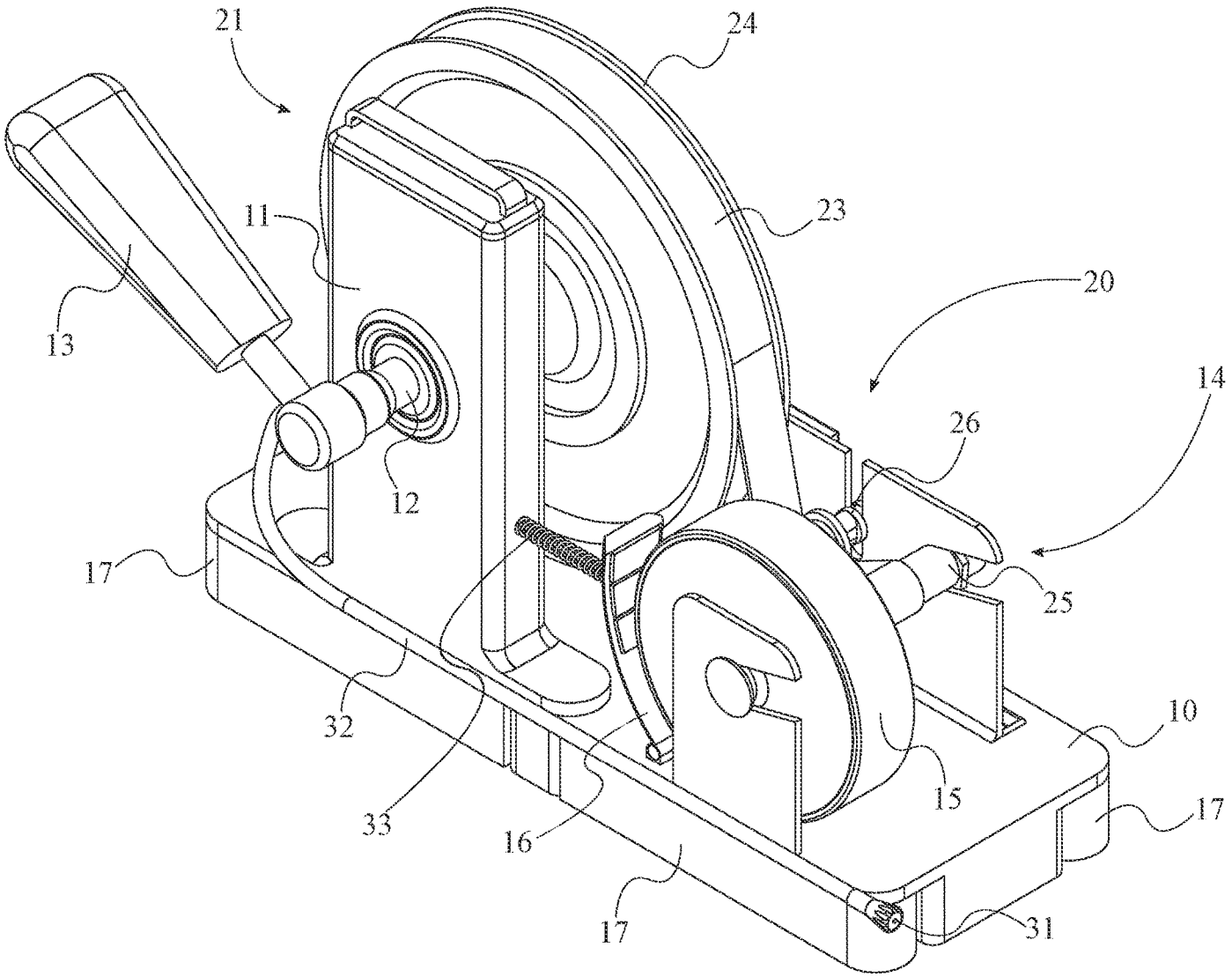
FIG. 1 is a top-front-left perspective view of the present invention in an exemplary form.
Figure 2:
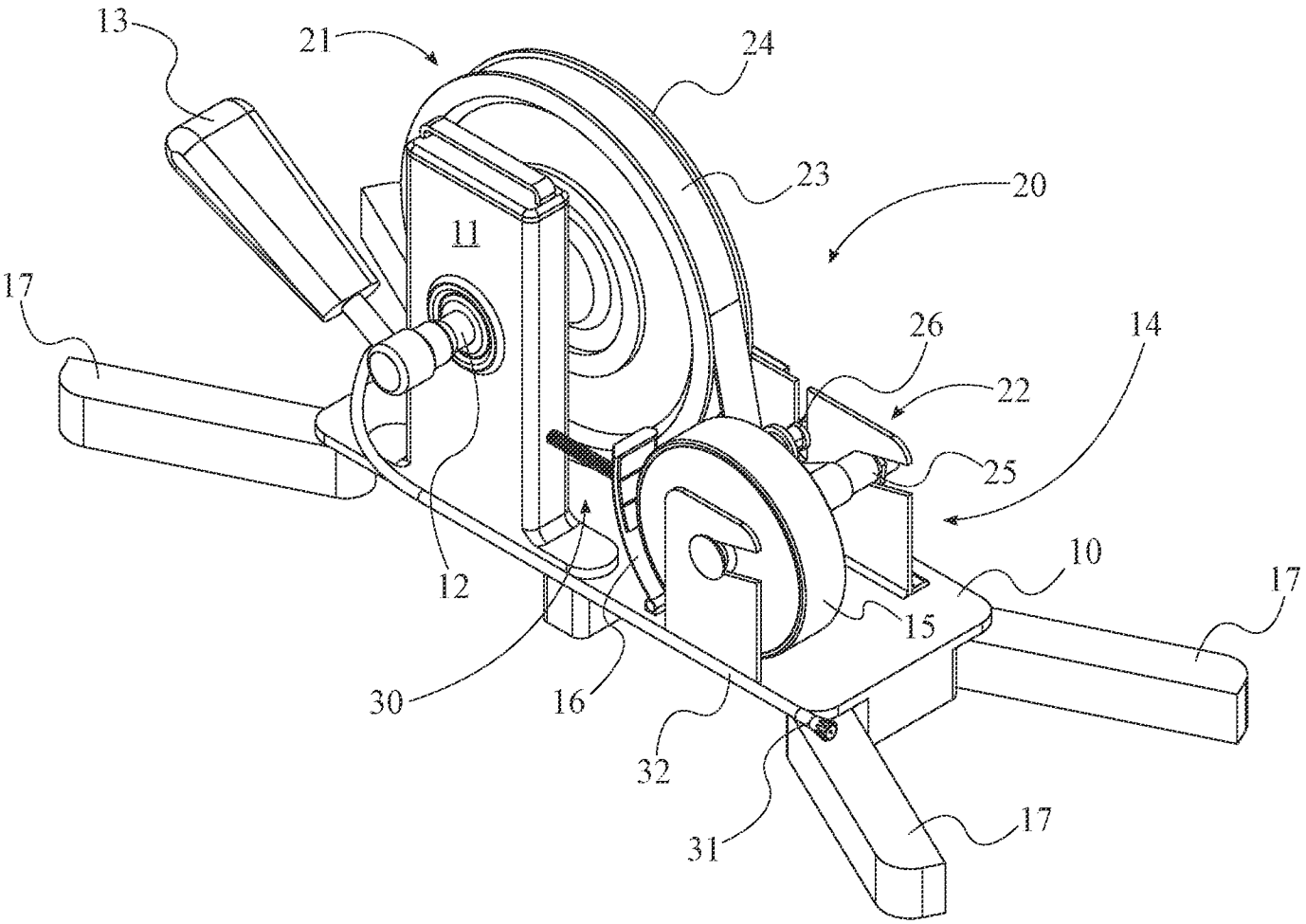
FIG. 2 is another top-front left perspective view thereof, wherein the footprint extenders have been deployed by the present invention.
Figure 3:
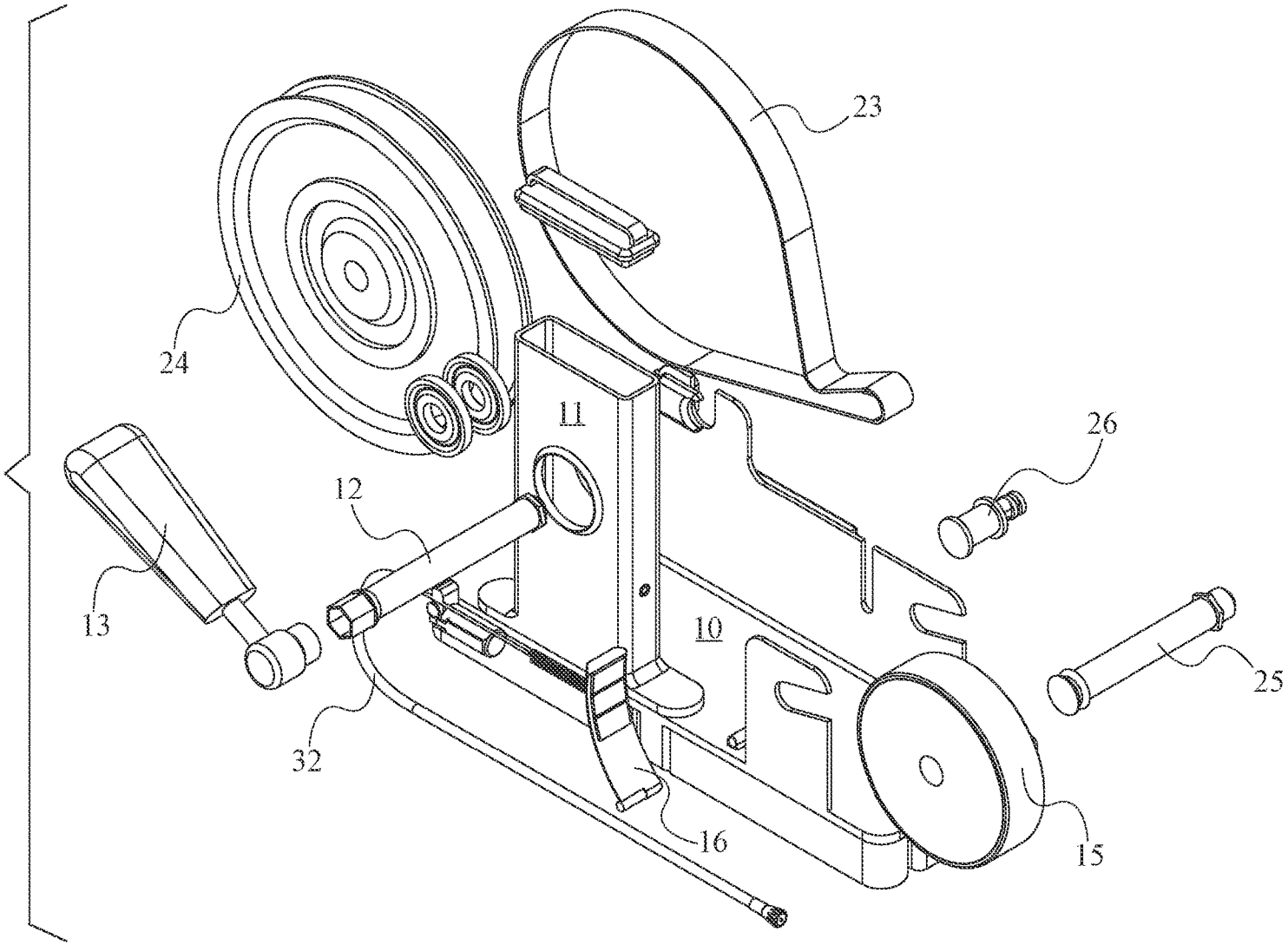
FIG. 3 is an exploded view thereof.
Figure 5:
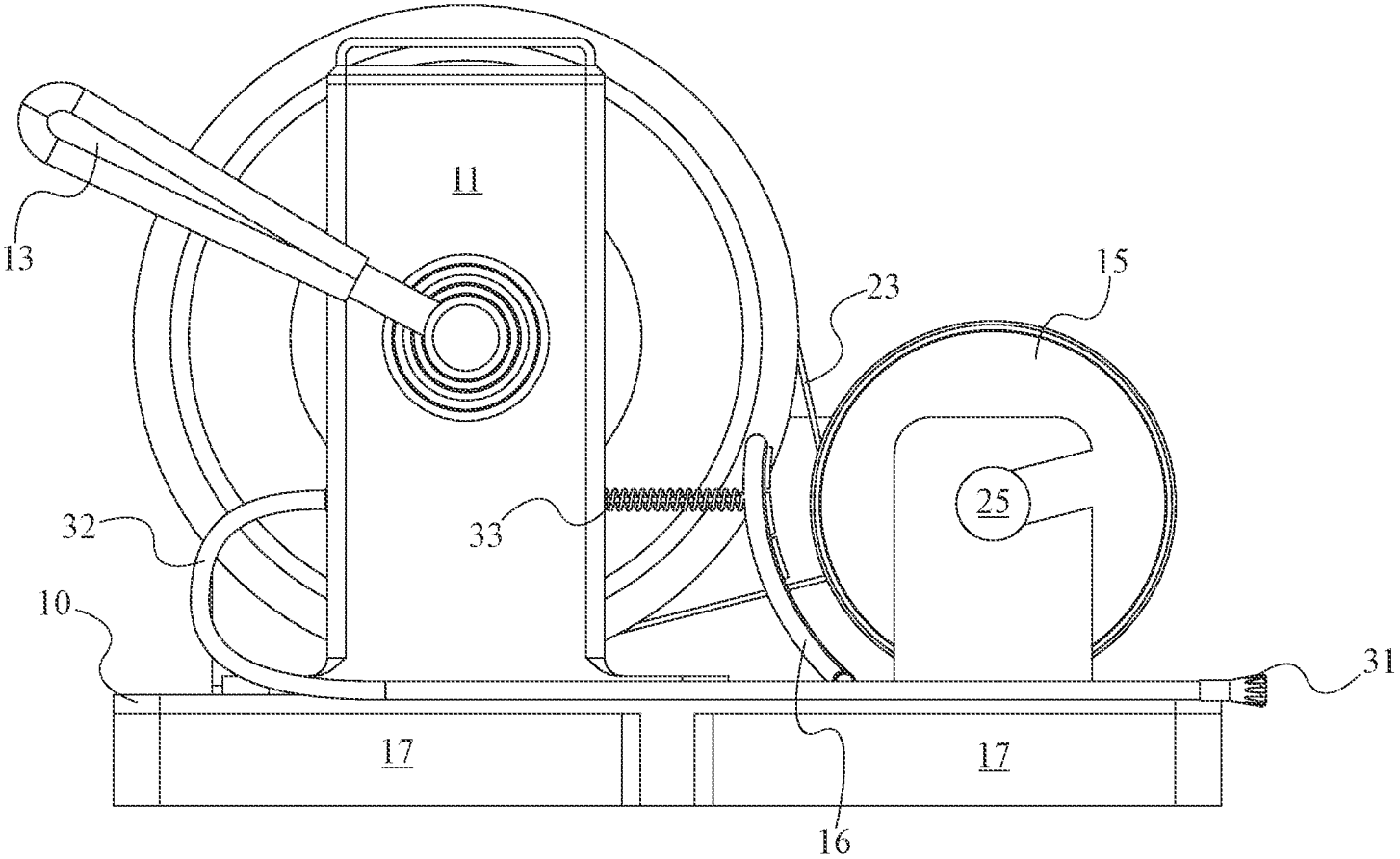
FIG. 5 is a front elevational view thereof.
Figure 6:
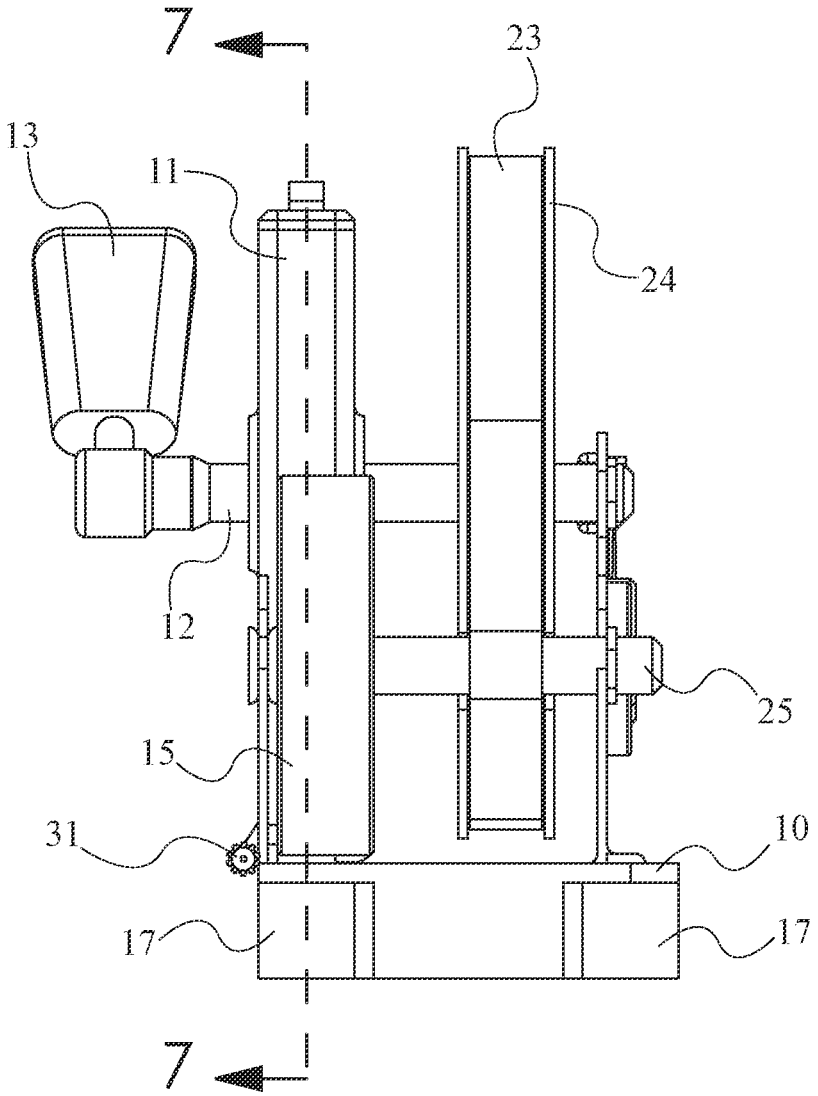
FIG. 6 is a left-side elevational view of the present invention.

In reference to FIG. 1, FIG. 3, and FIG. 5, to achieve the above-described functionalities, the present invention comprises a base platform 10, an elongated superstructure 11, a first axle 12, at least one interchangeable handle 13, and the torsional-resistance mechanism 14. The base platform 10 constitutes a substantially planar structural arrangement suitable to receive and support the otherwise disparate components of the present invention. The base platform 10 may be weighted to support the present invention in an upright position during use, either intentionally or due to the inherent static mass of other mounted components.

The general configuration of the aforementioned components allows the present invention to efficiently and effectively support a pronation and supination exercise by providing variable, scalable resistance against the torsion of a user's forearm. This type of exercise, performed in increasingly difficult iterations, may aid in the formation or reformation of neural motor pathways supporting neuromuscular facilitation (i.e., muscle memory). Accordingly, the elongated superstructure 11 is connected normal to the base platform 10. The elongated superstructure 11 ideally defines a hollow tubular stanchion extending perpendicular from the common plane of the base platform 10. In reference to FIG. 3 and FIG. 7, the preferred embodiment enables the use of the interior cavity of the elongated superstructure 11 not otherwise occupied by working components for storage of retention straps, spare parts, or other accessory items. Ancillary uses aside, the elongated superstructure 11 is primarily configured to support the first axle 12. The first axle 12 is rotatably mounted through the elongated superstructure 11, positioned offset from the base platform 10, and positioned perpendicular to the elongated superstructure 11. In this elevated position the first axle 12 provides a suitable axis about which a pronation and supination exercise may be performed, wherein the torsion of a user's forearm is approximated by the first axle 12. Further, at least one interchangeable handle 13 is terminally attached to the first axle 12. In this arrangement, the first axle 12 defines a bearing-mounted rotating element positioned roughly incident with a user's shoulder. The position of the first axle 12 at an offset to any other obstructing components enables the interchangeable handle 13 to traverse a full range of motion during use.

The interchangeable handle 13, as implied, is a removeable and replaceable component of the present invention, enabling a user to customize any given embodiment of the present invention to suit a particular need or exercise program. In the exemplary illustration, the bar-type embodiment of the interchangeable handle 13 in FIG. 1 may be grasped by the user's arm aligned to a deflected axis relative to the first axle 12. In an alternate embodiment, the interchangeable handle 13 may be replaced by a mid-plane haft iteration of the interchangeable handle 13 to enable a user to perform exercises with their arm coaxial to the first axle 12.

The torsional-resistance mechanism 14 is mounted onto the base platform 10, operatively coupled to the first axle 12, and used to resist rotation of the first axle 12. The torsional-resistance mechanism 14 may define any type, variety, or combination of magnetic rotor, turbine, hydraulic brake, static-elastic assembly, or any other rotating assembly capable of providing a counter-rotational force in response to an initial rotation. More specifically, the torsional-resistance mechanism 14 is engaged to the first axle 12 to resist the rotation of the first axle 12 caused by a user via the interchangeable handle 13. Finer adjustments of the resistance value provided via the torsional-resistance mechanism 14 may enable a user to scale and moderate the effective standing inertia of the first axle 12 by adjusting a braking force applied to the torsional-resistance mechanism 14.

Figure 7:
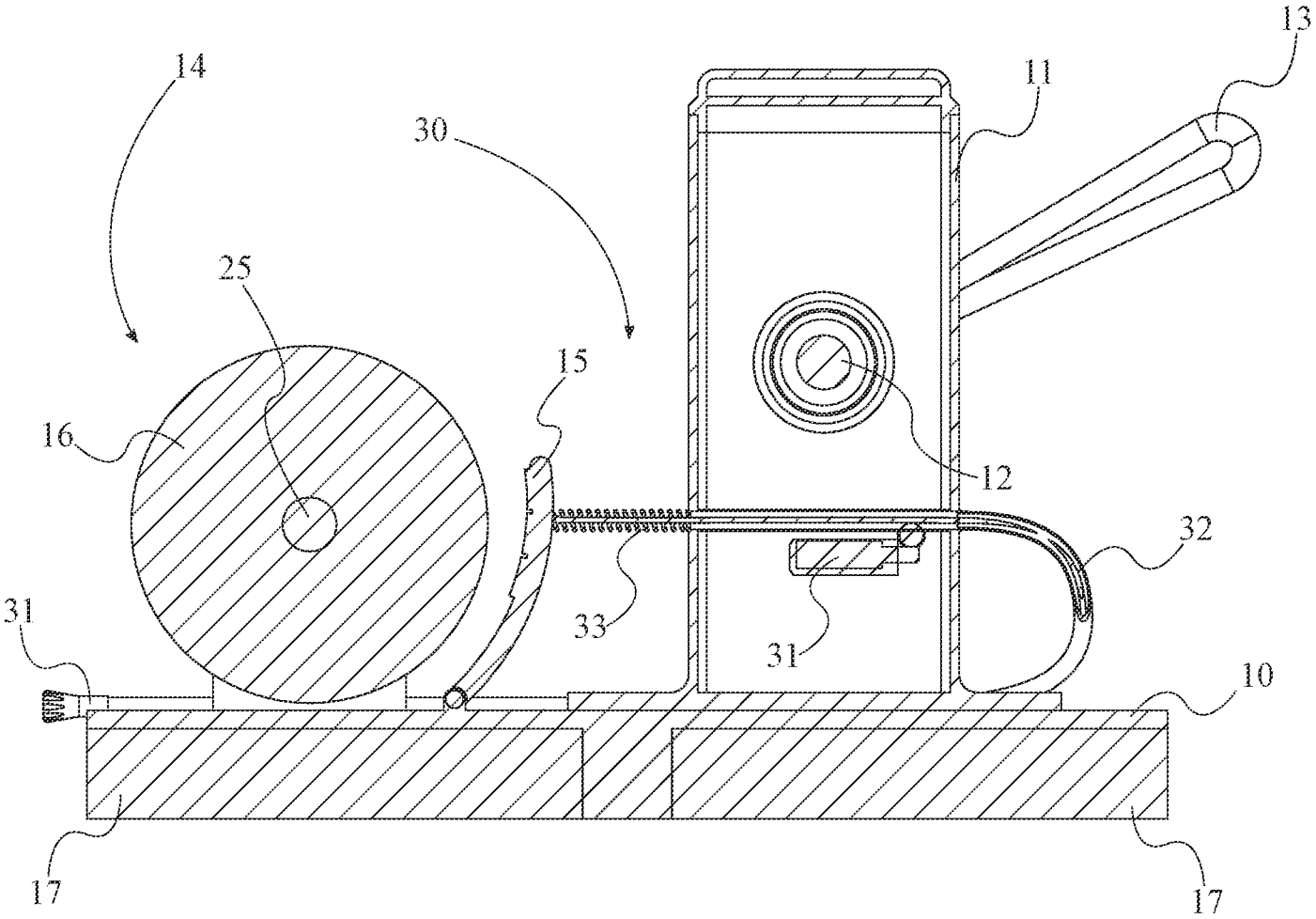
FIG. 7 is a cross-sectional view of the present invention taken along line 7-7 in FIG. 6.

The torsional-resistance mechanism 14 may further comprise a power transmission 20, a magnetic rotor 15, a magnetic cantilever 16, and a gap-adjustment mechanism 30 as shown in FIG. 1 and FIG. 7. The power transmission 20 is any means of transmitting torsional force, including any means of affecting transmission ratios between rotation rate or torque between any interconnected components. More specifically, the power transmission 20 comprises a transmission input 21 and a transmission output 22. The transmission input 21 defines a component receiving an initial force, and the transmission output 22 defines a component motivated by the initial force post-conversion within the power transmission 20. Moreover, the magnetic rotor 15 ideally defines a conductive drum that, when operated in conjunction with the magnetic cantilever 16, comprises an eddy current brake. This type of brake enables kinetic force to be converted into thermal energy via the introduction of a magnetic field into a conductive mobile element, i.e., the magnetic cantilever 16 and the magnetic rotor 15. Accordingly, the magnetic cantilever 16 defines an articulating member carrying a volume of magnetic material into proximity with the magnetic rotor 15. This proximity is moderated by the gap-adjustment mechanism 30, broadly referring to any conceivable form of advancing or retracting the magnetic cantilever 16 relative to the magnetic rotor 15.

According to the above-described functionality, the magnetic rotor 15 is rotatably mounted onto the base platform 10, offset from the elongated superstructure 11, and the magnetic cantilever 16 is mounted onto the base platform 10, peripheral to the magnetic rotor 15. This arrangement enables the magnetic cantilever 16 to traverse into operational range of the magnetic rotor 15 without obstructing the normal rotation of the magnetic rotor 15. Further, the transmission input 21 is torsionally mounted to the first axle 12, and the transmission output 22 is torsionally mounted to the magnetic rotor 15, which allows rotational motion to transfer from the first axle 12, through the power transmission 20, and to the magnetic rotor 15. Finally, the magnetic cantilever 16 is operatively coupled with the magnetic rotor 15 by the gap-adjustment mechanism 30, wherein the gap-adjustment mechanism 30 is used to proportionately adjust a magnetic force between the magnetic cantilever 16 and the magnetic rotor 15 in accordance with a gap distance between the magnetic cantilever 16 and the magnetic rotor 15. The variable gap distance consequently affects the braking force applied via the magnetic rotor 15, consequently affecting the holding torque of the first axle 12. In concept, a lower gap distance results in greater holding torque, while a greater gap distance results in lesser holding torque.

In an exemplary embodiment of the present invention, the power transmission 20 further comprises a serpentine belt 23, the transmission input 21 is a flywheel 24, and the transmission output 22 is a second axle 25. In the embodiment illustrated in FIG. 4 and FIG. 6, the flywheel 24 is torsionally connected to the first axle 12, and the second axle 25 is torsionally connected to the magnetic rotor 15. The flywheel 24 defines a rotating mass configured to smooth the inertial torque exerted upon the interchangeable handle 13 and, by extension, a user's arm. In contrast to a braking action driven solely by the interaction of the magnetic rotor 15 and the magnetic cantilever 16, the flywheel 24 may enable a user to controllably over-rotate their wrist during pronation or supination exercises to gradually expand their range of motion and stretch otherwise atrophied tissues. The attachment of a second axle 25 further provides a definitive engagement component between the magnetic rotor 15 and the first axle 12 through the power transmission 20. Moreover, the serpentine belt 23 is tensionably and frictionally engaged in between the flywheel 24 and the second axle 25, thereby enabling torsional force to be transferred through the power transmission 20.

The power transmission 20 may further comprise a belt tensioner 26. The belt tensioner 26 defines an adjustable idler pulley, or similar implement, typically or commonly utilized in belt-driven assemblies. In practice, the belt tensioner 26 is advanced into the normal path of the serpentine belt 23 to draw the serpentine belt 23 taught and ensure constant contact of the serpentine belt 23 against the flywheel 24 and the second axle 25. Accordingly, the belt tensioner 26 is rotatably mounted onto the base platform 10, and the serpentine belt 23 is tensionably and frictionally engaged to the belt tensioner 26.

The gap-adjustment mechanism 30 may comprise an incremental tensioner 31, a control cable 32, and a spring 33. The incremental tensioner 31 is mounted onto the base platform 10, and the control cable 32 is slidably mounted through the elongated superstructure 11, which allows the control cable 32 to be tethered between the incremental tensioner 31 and the magnetic cantilever 16. The ideal embodiment of the incremental tensioner 31 constitutes a threaded uptake mechanism, wherein the control cable 32 defines a male-threaded solid wire engaged into the female threads of the incremental tensioner 31. Thus engaged, rotating the incremental tensioner 31 about the control cable 32 retracts the control cable 32 through the elongated superstructure 11. Consequently, the magnetic cantilever 16 is drawn towards the elongated superstructure 11, widening the gap between the magnetic cantilever 16 and the magnetic rotor 15. To ensure that the magnetic cantilever 16 remains under constant tension, the spring 33 is laterally positioned around the control cable 32 and pressed in between the elongated superstructure 11 and the magnetic cantilever 16. The spring 33 ideally forces the magnetic cantilever 16 away from the elongated superstructure 11 to remove any slack in the control cable 32, while the incremental tensioner 31 is utilized to reduce the exposed length of control cable 32 and draw the magnetic cantilever 16 towards the elongated superstructure 11. It is generally considered that this manual adjustment mechanism features multiple detents or hard-stops corresponding to preset resistance values, though it is understood that the adjustment values of the incremental tensioner 31 is infinitely granular.

Portions of the above-outlined functionalities may be digitized to improve patient monitoring and to potentially automate portions of exercise moderation processes. More specifically, the present invention may further comprise a microcontroller 40 and a rotary encoder 41. The microcontroller 40 generally refers to any logical processor, computational unit, motor controller, or other digitized data-handling engine as may be recognized by a reasonably skilled individual. The rotary encoder 41 defines a data-input device configured to convert the rotation of any target or subject into machine-readable values. Accordingly, the rotary encoder 41 is operatively coupled to the first axle 12, wherein the rotary encoder 41 is used to collect rotation data of the first axle 12. Thus, the rotary encoder 41 is electronically connected to the microcontroller 40, enabling the microcontroller 40 to receive, store, present, convert, analyze, or otherwise transform the raw rotational data from the rotary encoder 41.

Figure 4:
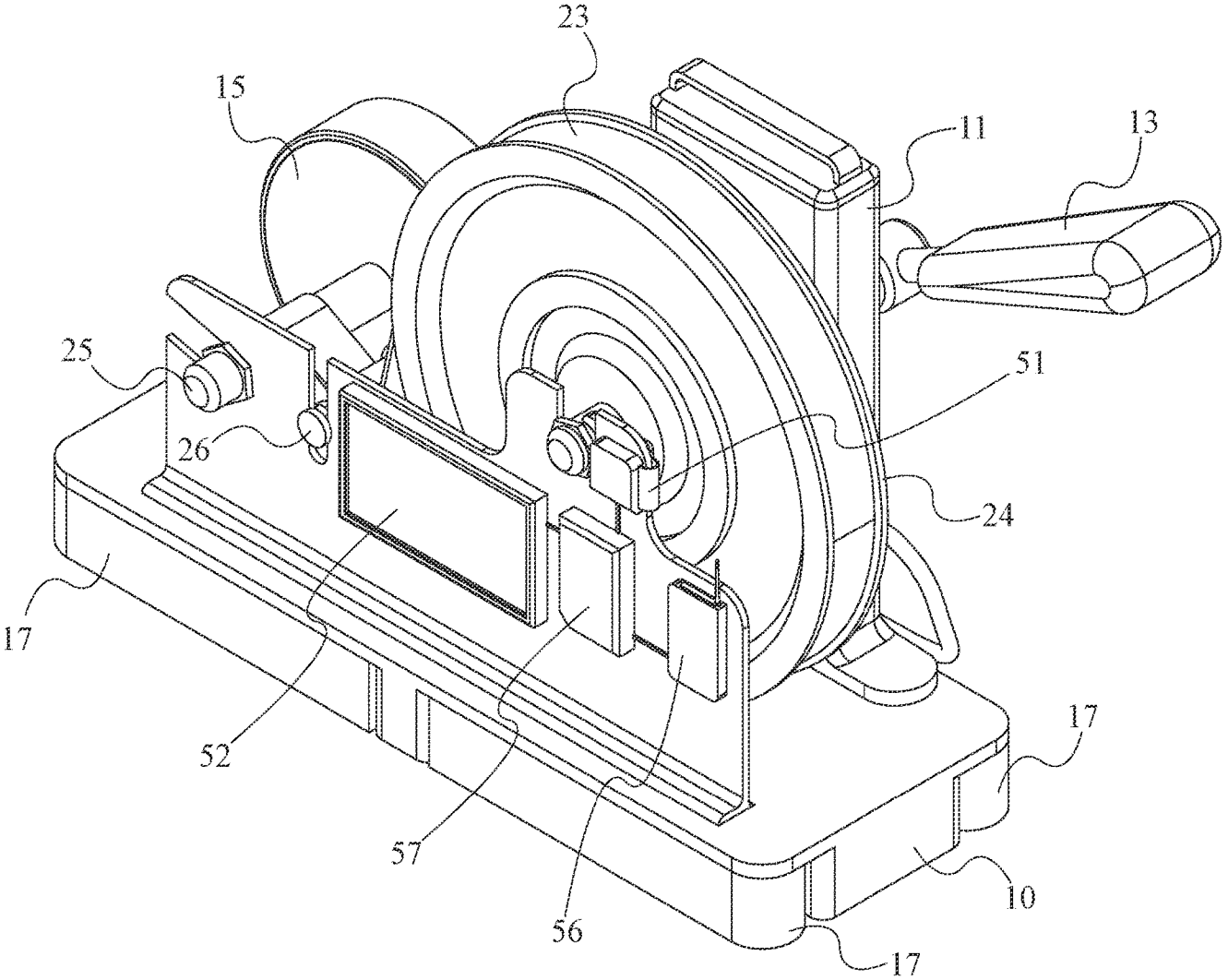
FIG. 4 is top-rear-right perspective view thereof.

As can be seen in FIG. 4, the present invention may further comprise a display 42 that is used to visualize the aforementioned rotational data of the first axle 12. The display 42 is mounted onto the base platform 10 and is electronically connected to the microcontroller 40 so that the microcontroller 40 is able to communicate a viewable version of this rotational data to the display 42. Though the orientation of the exemplary display 42 may be ideal for use by an assistant user or physical therapist, it is proposed that the display 42 may be mounted to the base platform 10 in such a way as to be visible to a user actively engaged in exercise to enable contemporaneous monitoring of the display 42.

In order to expand the digital functions of the present invention, the present invention may further comprise a wireless communication module 43. The wireless communication module 43 defines any type or variety of wireless transceivers, including both short and long-range capacities as may be suitable for any given application. The wireless communication module 43 is electronically connected to the microcontroller 40 to enable the transfer of formatted data to any external terminal or recipient. With this functionality, a local smartphone or tablet might be utilized as a surrogate display, or as a data recorder for exercise improvement over time to track the progression of a patient through a rehabilitation regimen. Further, progression data may be automatically transmitted to an off-site server for review by therapists or other medical care providers to maximize the number of concurrent patients that a single provider might treat.

To further expand upon the automatic functionality of the present invention, a means to automate the continuously variable resistance provided by the torsional-resistance mechanism 14 is provided. In this embodiment, the torsional-resistance mechanism 14 needs to further comprise the gap-adjustment mechanism 30 so that the incremental tensioner 31 of the gap-adjustment mechanism 30 can be electronically connected to the microcontroller 40. This embodiment of the incremental tensioner 31 defines a stepper motor and gearbox, motorized spool, or other mechanized uptake device suitable for retracting a length of the control cable 32 according to operable commands issued via the microcontroller 40. The adjustment process enabled in this embodiment may be performed continuously to provide a constant resistive force to a patient. E.g., as the measured input rotational value from the rotary encoder 41 decreases, indicating a reduction in user-applied force, the incremental tensioner 31 will retract the control cable 32 to reduce the braking force generated by the magnetic rotor 15 and the magnetic cantilever 16.

It is considered that, as a patient improves their motor skills and upper-body strength, the force exerted against the interchangeable handle 13 might exceed the capacity for the base platform 10 to remain stable. Thus, the present invention may further comprise a plurality of footprint extenders 17, which are peripherally mounted to the base platform 10. In the exemplary embodiment shown in FIG. 2, the plurality of footprint extenders 17 constitutes a series of collapsible spars hingedly mounted into the base platform 10 opposite the elongated superstructure 11. The plurality of footprint extenders 17 may be operably extended to increase the effective footprint of the base platform 10 or collapsed into the original footprint to facilitate storage or transport. In another embodiment, the plurality of footprint extenders 17 may define a series of detachable, flared risers engaged into the base platform 10 to provide a measure of shock-absorption between the base platform 10 and any external mounting surface. It is further considered that the plurality of footprint extenders 17, in these embodiments or any others, may be supplemented by mechanical, chemical, vacuum-operated, or magnetic fasteners of any kind.

Although the invention has been explained in relation to its preferred embodiment, it is to be understood that many other possible modifications and variations can be made without departing from the spirit and scope of the invention as hereinafter claimed.

What is claimed is:

1. An adaptive device utilizing neuroplasticity for a rehabilitation of stroke victims, the adaptive device comprising:

a base platform;

an elongated superstructure;

a first axle;

at least one interchangeable handle;

a torsional-resistance mechanism;

the elongated superstructure being connected normal to the base platform;

the first axle being rotatably mounted through the elongated superstructure;

the first axle being positioned offset from the base platform;

the first axle being positioned perpendicular to the elongated superstructure;

the at least one interchangeable handle being terminally attached to the first axle;

the torsional-resistance mechanism being mounted onto the base platform;

the torsional-resistance mechanism being operatively coupled to the first axle, wherein the torsional-resistance mechanism is used to resist rotation of the first axle;

the torsional-resistance mechanism further comprising a power transmission, a magnetic rotor, a magnetic cantilever, and a gap-adjustment mechanism;

the power transmission comprising a transmission input and a transmission output;

the magnetic rotor being rotatably mounted onto the base platform, offset from the elongated superstructure;

the magnetic cantilever being mounted onto the base platform, peripheral to the magnetic rotor;

the transmission input being torsionally mounted to the first axle;

the transmission output being torsionally mounted to the magnetic rotor;

the magnetic cantilever being operatively coupled with the magnetic rotor by the gap-adjustment mechanism, wherein the gap-adjustment mechanism is used to proportionately adjust a magnetic force between the magnetic cantilever and the magnetic rotor in accordance with a gap distance between the magnetic cantilever and the magnetic rotor;

the gap-adjustment mechanism comprising an incremental tensioner, a control cable, and a spring;

the incremental tensioner being mounted onto the base platform;

the control cable being slidably mounted through the elongated superstructure;

the control cable being tethered between the incremental tensioner and the magnetic cantilever;

the spring being laterally positioned around the control cable; and the spring being pressed in between the elongated superstructure and the magnetic cantilever.

2. The adaptive device as claimed in claim 1 further comprising:

the power transmission further comprising a serpentine belt;

the transmission input being a flywheel;

the transmission output being a second axle;

the flywheel being torsionally connected to the first axle;

the second axle being torsionally connected to the magnetic rotor; and the serpentine belt being tensionably and frictionally engaged in between the flywheel and the second axle.

3. The adaptive device as claimed in claim 2 further comprising:

the power transmission further comprising a belt tensioner;

the belt tensioner being rotatably mounted onto the base platform; and the serpentine belt being tensionably and frictionally engaged to the belt tensioner.

4. The adaptive device as claimed in claim 1 further comprising:

a microcontroller;

a rotary encoder;

the rotary encoder being operatively coupled to the first axle, wherein the rotary encoder is used to collect rotation data of the first axle; and the rotary encoder being electronically connected to the microcontroller.

5. The adaptive device as claimed in claim 4 further comprising:

a display;

the display being mounted onto the base platform; and the display being electronically connected to the microcontroller.

6. The adaptive device as claimed in claim 4 further comprising:

a wireless communication module; and the wireless communication module being electronically connected to the microcontroller.

7. The adaptive device as claimed in claim 4 wherein the incremental tensioner of the gap-adjustment mechanism being electronically connected to the microcontroller.

8. The adaptive device as claimed in claim 1 further comprising:

a plurality of footprint extenders; and the plurality of footprint extenders being peripherally mounted to the base platform.

9. An adaptive device utilizing neuroplasticity for a rehabilitation of stroke victims, the adaptive device comprising:

a base platform;

an elongated superstructure;

a first axle;

at least one interchangeable handle;

a torsional-resistance mechanism;

the torsional-resistance mechanism further comprising a power transmission, a magnetic rotor, a magnetic cantilever, and a gap-adjustment mechanism;

the power transmission comprising a transmission input and a transmission output;

the elongated superstructure being connected normal to the base platform;

the first axle being rotatably mounted through the elongated superstructure;

the first axle being positioned offset from the base platform;

the first axle being positioned perpendicular to the elongated superstructure;

the at least one interchangeable handle being terminally attached to the first axle;

the torsional-resistance mechanism being mounted onto the base platform;

the torsional-resistance mechanism being operatively coupled to the first axle, wherein the torsional-resistance mechanism is used to resist rotation of the first axle;

the magnetic rotor being rotatably mounted onto the base platform, offset from the elongated superstructure;

the magnetic cantilever being mounted onto the base platform, peripheral to the magnetic rotor;

the transmission input being torsionally mounted to the first axle;

the transmission output being torsionally mounted to the magnetic rotor;

the magnetic cantilever being operatively coupled with the magnetic rotor by the gap-adjustment mechanism, wherein the gap-adjustment mechanism is used to proportionately adjust a magnetic force between the magnetic cantilever and the magnetic rotor in accordance with a gap distance between the magnetic cantilever and the magnetic rotor;

the gap-adjustment mechanism comprising an incremental tensioner, a control cable, and a spring;

the incremental tensioner being mounted onto the base platform;

the control cable being slidably mounted through the elongated superstructure;

the control cable being tethered between the incremental tensioner and the magnetic cantilever;

the spring being laterally positioned around the control cable; and the spring being pressed in between the elongated superstructure and the magnetic cantilever.

10. The adaptive device as claimed in claim 9 further comprising:

the power transmission further comprising a serpentine belt and a belt tensioner;

the transmission input being a flywheel;

the transmission output being a second axle;

the flywheel being torsionally connected to the first axle;

the second axle being torsionally connected to the magnetic rotor;

the serpentine belt being tensionably and frictionally engaged in between the flywheel and the second axle;

the belt tensioner being rotatably mounted onto the base platform; and the serpentine belt being tensionably and frictionally engaged to the belt tensioner.

11. The adaptive device as claimed in claim 9 further comprising:

a microcontroller;

a rotary encoder;

a display;

a wireless communication module;

the rotary encoder being operatively coupled to the first axle, wherein the rotary encoder is used to collect rotation data of the first axle;

the rotary encoder being electronically connected to the microcontroller;

the display being mounted onto the base platform;

the display being electronically connected to the microcontroller;

the wireless communication module being electronically connected to the microcontroller; and the incremental tensioner of the gap-adjustment mechanism being electronically connected to the microcontroller.

12. The adaptive device as claimed in claim 9 further comprising:

a plurality of footprint extenders; and the plurality of footprint extenders being peripherally mounted to the base platform.

13. An adaptive device utilizing neuroplasticity for a rehabilitation of stroke victims, the adaptive device comprising:

a base platform;

an elongated superstructure;

a first axle;

at least one interchangeable handle;

a torsional-resistance mechanism;

the torsional-resistance mechanism further comprising a power transmission, a magnetic rotor, a magnetic cantilever, and a gap-adjustment mechanism;

the power transmission comprising a transmission input, a transmission output, a serpentine belt, and a belt tensioner;

the elongated superstructure being connected normal to the base platform;

the first axle being rotatably mounted through the elongated superstructure;

the first axle being positioned offset from the base platform;

the first axle being positioned perpendicular to the elongated superstructure;

the at least one interchangeable handle being terminally attached to the first axle;

the torsional-resistance mechanism being mounted onto the base platform;

the torsional-resistance mechanism being operatively coupled to the first axle, wherein the torsional-resistance mechanism is used to resist rotation of the first axle;

the magnetic rotor being rotatably mounted onto the base platform, offset from the elongated superstructure;

the magnetic cantilever being mounted onto the base platform, peripheral to the magnetic rotor;

the transmission input being torsionally mounted to the first axle;

the transmission output being torsionally mounted to the magnetic rotor;

the magnetic cantilever being operatively coupled with the magnetic rotor by the gap-adjustment mechanism, wherein the gap-adjustment mechanism is used to proportionately adjust a magnetic force between the magnetic cantilever and the magnetic rotor in accordance with a gap distance between the magnetic cantilever and the magnetic rotor;

the transmission input being a flywheel;

the transmission output being a second axle;

the flywheel being torsionally connected to the first axle;

the second axle being torsionally connected to the magnetic rotor;

the serpentine belt being tensionably and frictionally engaged in between the flywheel and the second axle;

the belt tensioner being rotatably mounted onto the base platform;

the serpentine belt being tensionably and frictionally engaged to the belt tensioner;

the gap-adjustment mechanism comprising an incremental tensioner, a control cable, and a spring;

the incremental tensioner being mounted onto the base platform;

the control cable being slidably mounted through the elongated superstructure;

the control cable being tethered between the incremental tensioner and the magnetic cantilever;

the spring being laterally positioned around the control cable; and the spring being pressed in between the elongated superstructure and the magnetic cantilever.

14. The adaptive device as claimed in claim 13 further comprising:

a microcontroller;

a rotary encoder;

a display;

a wireless communication module;

the rotary encoder being operatively coupled to the first axle, wherein the rotary encoder is used to collect rotation data of the first axle;

the rotary encoder being electronically connected to the microcontroller;

the display being mounted onto the base platform;

the display being electronically connected to the microcontroller;

the wireless communication module being electronically connected to the microcontroller; and the incremental tensioner of the gap-adjustment mechanism being electronically connected to the microcontroller.

15. The adaptive device as claimed in claim 13 further comprising:

a plurality of footprint extenders; and the plurality of footprint extenders being peripherally mounted to the base platform.

* * * * *